US009779576B2

(12) United States Patent
Shoenhair et al.

(10) Patent No.: US 9,779,576 B2
(45) Date of Patent: Oct. 3, 2017

(54) METHODS AND SYSTEMS FOR MAGNIFYING SELECTION WINDOWS IN ROULETTE GAMES AND ACCESSING CUSTOM WAGERING PROFILES

(71) Applicant: Zynga Inc., San Francisco, CA (US)

(72) Inventors: Thomas Arthur Shoenhair, Lafayette, CA (US); Ibrahim Nabil Rageh, Pleasant Hill, CA (US); Christopher Mark Karo, San Rafael, CA (US)

(73) Assignee: Zynga Inc., San Francisco, CA (US)

( * ) Notice: Subject to any disclaimer, the term of this patent is extended or adjusted under 35 U.S.C. 154(b) by 0 days.

(21) Appl. No.: 14/622,714

(22) Filed: Feb. 13, 2015

(65) Prior Publication Data

US 2016/0019743 A1 Jan. 21, 2016

Related U.S. Application Data

(63) Continuation-in-part of application No. 14/333,503, filed on Jul. 16, 2014, now Pat. No. 9,582,958.

(60) Provisional application No. 62/057,160, filed on Sep. 29, 2014.

(51) Int. Cl.
*G07F 17/32* (2006.01)

(52) U.S. Cl.
CPC ..... *G07F 17/3209* (2013.01); *G07F 17/326* (2013.01); *G07F 17/329* (2013.01); *G07F 17/3211* (2013.01)

(58) Field of Classification Search
CPC ..... A63F 5/0005; A63F 5/0094; A63F 5/02; A63F 5/04; A63F 7/00; G07F 17/3209; G07F 17/3211; G07F 17/326; G07F 17/329
USPC ..... 463/17
See application file for complete search history.

(56) References Cited

U.S. PATENT DOCUMENTS

| | | | | |
|---|---|---|---|---|
| 7,331,868 | B2 * | 2/2008 | Beaulieu | G07F 17/34 463/30 |
| 7,758,425 | B2 * | 7/2010 | Poh | A63F 13/00 273/139 |
| 8,147,319 | B2 * | 4/2012 | Hornik | G07F 17/32 463/16 |

(Continued)

OTHER PUBLICATIONS

"Scarne's Complete Guide to Gambling," by John Scarne, Simon & Schuster, 1961, chapter on roulette.*

*Primary Examiner* — David L Lewis
*Assistant Examiner* — Matthew D. Hoel
(74) *Attorney, Agent, or Firm* — Martine Penilla Group, LLP

(57) ABSTRACT

A method for facilitating placement of wagers in an online game during game play includes displaying a first view of a wagering grid for an online game, with the wagering grid having lines. The method further includes receiving an input that is a gesture representing placement of a wager by a user on the wagering grid, and displaying a second view of the wagering grid that is a pop-up view. The second view, which can be a zoomed view or a magnified view, excludes any other placed wagers to facilitate placement of the wager by the user with respect to the lines of the wagering grid. Once the user has placed the wager, the method includes displaying an updated version of the first view that includes the wager placed by the user. In one example, the online game is a roulette game.

20 Claims, 9 Drawing Sheets

(56) References Cited

U.S. PATENT DOCUMENTS 8,177,628 B2 * 5/2012 Manning ..... G06Q 20/3224 273/138.1
8,622,830 B2 * 1/2014 Radek ..... G07F 17/32 463/30
9,384,624 B2 * 7/2016 Fong ..... G07F 17/3262
2004/0116177 A1 * 6/2004 Frost ..... A63F 3/081 463/17
2004/0166930 A1 * 8/2004 Beaulieu ..... G07F 17/34 463/25
2004/0259627 A1 * 12/2004 Walker ..... G07F 17/3211 463/20
2005/0032568 A1 * 2/2005 Griswold ..... G07F 17/34 463/16
2005/0181852 A1 * 8/2005 Groves ..... G07F 17/3293 463/13
2006/0148549 A1 * 7/2006 Walker ..... G07F 17/32 463/16
2007/0149283 A1 * 6/2007 Poh ..... A63F 13/00 463/37
2007/0173310 A1 * 7/2007 Walker ..... G07F 17/32 463/16
2007/0254733 A1 * 11/2007 Hornik ..... G07F 17/32 463/20
2008/0058068 A1 * 3/2008 Bennett ..... G07F 17/34 463/20
2008/0139297 A1 * 6/2008 Beaulieu ..... G07F 17/34 463/20
2008/0254876 A1 * 10/2008 Koustas ..... G07F 17/32 463/28
2008/0274783 A1 * 11/2008 Walker ..... G07F 17/32 463/13
2009/0005165 A1 * 1/2009 Arezina ..... G07F 17/3244 463/37
2009/0023495 A1 * 1/2009 Koustas ..... G06Q 50/34 463/25
2009/0098921 A1 * 4/2009 Manning ..... G06Q 20/3224 463/17
2010/0075744 A1 * 3/2010 Baratti ..... A63F 3/00157 463/22
2010/0120508 A1 * 5/2010 Vann ..... G07F 17/3202 463/20
2014/0100031 A1 * 4/2014 Fong ..... G07F 17/3262 463/31

* cited by examiner

Exemplary Layout of an Online Roulette Table

| | | | |
|---|---|---|---|
| A | Straight Bet - 1 number, pays 35:1 | G | Column Bet - 12 numbers, pays 2:1 |
| B | Split Bet - 2 numbers, pays17:1 | H | Dozen Bet - 12 numbers, pays 2:1 |
| C | Street Bet – 3 numbers, pay 11:1 | I | Red or Black – 18 numbers, pay 1:1 |
| D | Corner Bet – 4 numbers, pays 8:1 | J | Even or Odd – 18 numbers, pays 1:1 |
| E | Five Number Bet – 5 numbers, pays 6:1 | K | High or Low – 18 numbers, pays 1:1 |
| F | Line Bet – 6 numbers, pays 5:1 | | |

METHODS AND SYSTEMS FOR MAGNIFYING SELECTION WINDOWS IN ROULETTE GAMES AND ACCESSING CUSTOM WAGERING PROFILES

CLAIMS OF PRIORITY

This application claims priority to U.S. Provisional Application No. 62/057,160, entitled "Methods and Systems for Magnifying Selection Windows in Roulette Games and Accessing Custom Wager Profiles," filed on Sep. 29, 2014, and the disclosure of which is incorporated by reference herein for all purposes.

This application is a continuation-in-part of U.S. application Ser. No. 14/333,503, filed on Jul. 16, 2014, the disclosure of which is incorporated by reference herein for all purposes.

BACKGROUND

1. Field of the Invention

The present embodiments relate to methods for providing an online game, and more particularly, methods, systems, and computer programs for facilitating placement of wagers during game play of an online game.

2. Description of the Related Art

Online betting games have become very popular, including casino-style games, such as video slots, online poker, video poker, roulette, blackjack, etc. In order to attract players and to keep the players engaged for a long period of time, game developers try to provide interesting challenges, and unique variances to challenges within the game to make the game engaging, entertaining, interesting and challenging.

As more games are being developed, game developers are finding ways for keeping the players engaged. In some instances, more options to customize the game field, to personalize the game objects, to adjust the level of the game, etc., have been provided in order to attract and keep the players engaged. Increasing the options available to a player in the game improves players game play experience, which results in longer periods of engagement. Improving customer experience may result in increased betting and longer game play by the players, resulting in greater revenue to the game developers.

Players engaged in game play, especially in betting games, such as online pokers, roulette games, etc., sometimes forget what they bet on and how much they bet. With games, such as roulette games, where players can place multiple bets on different numbers, it is hard for the players to keep track of the bet/wager location, the type and amount of bets/wagers placed, and what type of payoff can be expected if they win the bet. Further, particularly in the case of roulette games, the clutter on the board by other players' chips can make it difficult for players to place their chips on the desired location, e.g., on a particular number or at the line intersection between numbers.

It is in this context that embodiments of the invention arise.

SUMMARY

Methods, devices, systems, and computer programs are presented for facilitating placement of wagers during game play of an online game, such as a roulette game. It should be appreciated that the present embodiments can be implemented in numerous ways, such as a method, an apparatus, a system, a device, or a computer program on a computer readable medium. Several embodiments are described below.

In one embodiment, a method for facilitating placement of wagers in an online game during game play is provided. The method includes displaying a first view of a wagering grid for an online game, with the wagering grid having lines. The method further includes receiving an input that is a gesture representing placement of a wager by a user on the wagering grid, and displaying a second view of the wagering grid that is a pop-up view. The second view excludes any other placed wagers to facilitate placement of the wager by the user with respect to the lines of the wagering grid. One the user has placed the wager, the method includes displaying an updated version of the first view that includes the wager placed by the user.

In one example, the online game is a roulette game. In one example, the second view is a zoomed view or a magnified view.

In one example, the method further includes displaying a third view that is a pop-up view that includes a menu that allows the user to save attributes of the wager for use in subsequent game play. In one example, the attributes of the wager that are saved for use in subsequent game play include the amount of the wager and the placement of the wager with respect to lines of the wagering grid. In one example, the third view is displayed in response to an input by the user that is a gesture, e.g., a long press.

In one example, the method further includes receiving an input from the user that results in placement of a saved wager on the wagering grid. In one example, the input is the press of a button.

In another embodiment, a non-transitory computer-readable storage medium having a computer program stored therein is provided. The computer program, when executed by a processor, causes a computer to perform the following operations: a) display a first view of a wagering grid for an online game, the wagering grid having lines; b) receive an input that is a gesture representing placement of a wager by a user on the wagering grid; c) display a second view of the wagering grid that is a pop-up view, wherein the second view excludes any other placed wagers to facilitate placement of the wager by the user with respect to the lines of the wagering grid; and d) display an updated version of the first view that includes the wager placed by the user. In one example, the online game is a roulette game.

Other aspects will become apparent from the following detailed description, taken in conjunction with the accompanying drawings.

BRIEF DESCRIPTION OF THE DRAWINGS

The embodiments may best be understood by reference to the following description taken in conjunction with the accompanying drawings.

DETAILED DESCRIPTION

Figure 1:
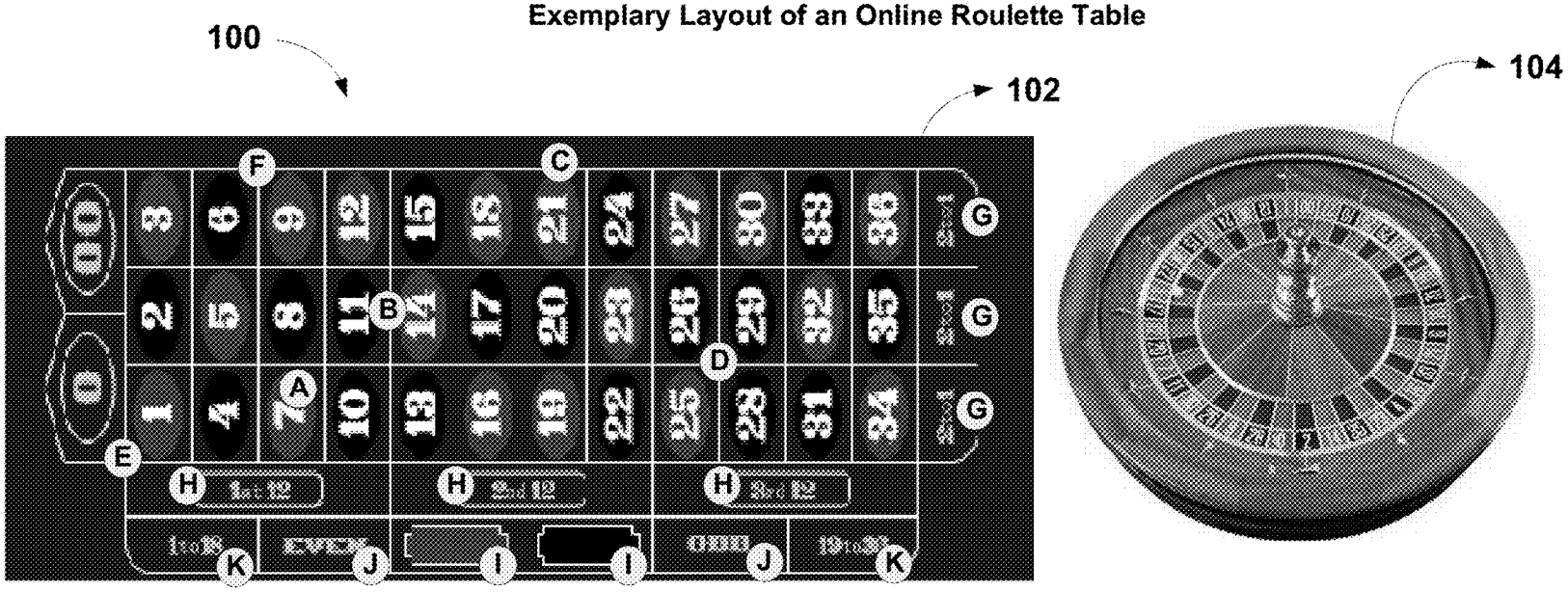
FIG. 1 depicts an interface for playing a video roulette game, according to one embodiment.

The following embodiments describe methods, devices, systems, and computer programs for facilitating placement of wagers during game play of an online game, such as a roulette game. It will be apparent, that the present embodiments may be practiced without some or all of these specific details. In other instances, well-known process operations have not been described in detail in order not to unnecessarily obscure the present embodiments.

One embodiment defines a method for placement of wagers in an online game in which a selection window is used to provide the player with an "uncluttered" view of the wagering grid by removing all the chips from within the selection window, except for the chip (or chips) being moved by the player. The selection window can provide "zoom" functionality to make it easier for the player to see the details, e.g., the numbers, lines, etc., of the wagering grid. Further, the player can save wagers for use in subsequent game play. More details regarding these features are described below with reference to FIGS. 2-10.

Other embodiments describe different types of animation that can be provided to an online roulette game during game play. Data for enabling an interface on a device (i.e., a client device) that is used for playing the online roulette game, is provided. The user interface is used to render a grid of bet entries for a roulette game and a roulette wheel on which a ball is provided for spinning to determine outcome of the roulette game. The bet entries identify distribution of different numbers of the roulette game and various types of betting options available during game play. One or more bets placed by the user during game play are identified. A number is generated randomly to define the outcome of the roulette game. The generated number corresponds to a number on the roulette wheel where the ball is to land, for that spin. The ball is caused to spin around the roulette game. When the ball approaches the generated number in the roulette wheel that corresponds to the generated number where the ball is to land, graphical animations are presented at the roulette wheel. These graphical animations alert a player of the wins for the game and the payout computed for the winning number based on the amount and type of bet placed on the winning number. The graphical animations may be provided in any one or combination of audio, visual, video, or other graphical forms to inform the players of the wins. Additionally, the graphic animations may also alert the players of the payout for the generated number as the ball approaches the number in the roulette wheel. The payout information may also be provided at numbers other than the generated number to alert the players of the potential payout so as to influence the players to play and place the bets on the numbers to maximize their wins. The system keeps track of the various numbers on which the player has placed his wager/bet and provides the graphic animation to inform the player of which number provided the win and how much payout was computed for each number, including the winning number for each game. In some embodiments, in addition to the payout information for each number, the system may also provide the various numbers the player has played in the game and the near miss in the payout for the placed wagers. The payout information on the numbers that the player has placed frequently that is near misses may be presented in a matrix format for easy review. The near misses may be on bet entries that were placed by the player during previous game plays within a given session or for the game as a whole and the information presented in the matrix format will reflect the details of the near miss payouts of the session or the game as a whole. Such information would help the players to plan their subsequent game plays so as to optimize their returns on wagers/bets. Conventional online roulette games do not provide such detailed information to the players to allow them to make informed decisions on which numbers to wager and how much to wager to have optimal winnings and game play experience.

FIG. 1 depicts a user interface that is provided with data for playing an online roulette game, according to one embodiment. When a user accesses the roulette game from his/her client device, the user interface 100 is presented. The data provided for the user interface includes a grid 102 of the roulette game. The grid identifies distribution of numbers associated with the roulette game and the various different types of bets/wagers that can be placed during game play. As illustrated in FIG. 1, the various types of bets are identified by reference letters, "A" through "K". Each of the bets/wagers is associated with a payout. FIG. 1 illustrates the payouts for each dollar/currency of wager/bet placed for different types of bets placed on the grid. For example, a straight bet is one in which a player places his/her wager on a single number (e.g., number 7, in the example illustrated in FIG. 1) on the grid. The payout for the single bet is 35:1. In other words, for every dollar wagered, a player may get back $35.00 in return, if the number 7 wins. In addition to the grid 102, the user interface renders a roulette wheel 104 for determining outcome of the roulette game. The roulette wheel includes a plurality of slots, with each of the plurality of slots associated with a number that corresponds to a number defined in the grid. A ball is provided at the roulette wheel for spinning, during the game play, to determine outcome of the roulette game. The roulette wheel using the ball is one exemplary tool for determining the outcome of the game and that other forms of roulette wheels, such as free spinning roulette wheel with an indicator, or any other form/tool for determining the outcome of the game, may be employed.

A roulette game application executing on a server provides data for the user interface as well as the graphical animation during game play. The game application may include one or more modules that keep track of the bets/wagers placed in the grid by the player, generate a number randomly to define the outcome of the roulette game, and provide graphical animation to provide visual indication of the outcome of the roulette game as the ball is caused to move around the roulette wheel toward a specific one of the slots defined in the roulette wheel that corresponds to the generated number. In some embodiments, the animation may be provided when the generated number matches the number on which the player has placed his bet. The game application, in one embodiment, may include a wager detector module, an input detector module, a random number generator module and an animation provider module. When a user accesses the roulette game, the user input at the client device may be used to send a request to the server and the server may return the data for enabling a user interface of the roulette game to be rendered on the display portion of the client device, in response to the request. The user interface (UI) renders a grid identifying a plurality of numbers and various types of bets that can be placed by a player during a game play. The UI also renders a roulette wheel on which a ball is provided for spinning to determine outcome of the game. The UI may include an option, which when selected, would cause the ball to spin around the roulette wheel toward a number that is generated randomly during game play. For example, the option may be a "spin" option in the form of a button. The aforementioned option and format are exemplary and should not be considered restrictive. Other options in varying formats may be provided to cause the ball to spin around the roulette wheel.

User input is detected at the user interface on the client device. The user input may be in the form of selection of one or more numbers in the grid of the roulette game (102 of FIG. 1) and placement of bets/wagers at each of the identified numbers. A user may place varying amount of bets/wagers on each of the identified numbers on the grid. In response to the user input at the grid, the wager detector module is configured to detect the user input, identify the selection of the numbers and the amount of wager placed at each number. Information from the wager detector module is shared with the animation provider module.

In response to the user input on the grid of the user interface, the input detector module may randomly generate a number corresponding to one of the numbers in the grid of the roulette game. A random number generator module may be employed by the input detector module to randomly generate the number. The generated number identifies a specific one of the plurality of slots in the roulette wheel where the ball is to land during game play. The randomly generated number is provided as input to the animation provider module.

The animation provider analyzes the information provided by the wager detector module to determine the number(s) in the grid where the user has placed his wager and uses randomly generated number provided by the input detector module to provide graphical animation at the roulette wheel. In one embodiment, the graphical animation provided at the roulette wheel may cause the ball to spin around the roulette wheel toward a specific one of the plurality of slots defined by the generated number. As the ball spins around the roulette wheel, additional graphical animation may be provided as the ball lands in the specific slot defined by the generated number. The animation may be to inform the user of the winning number for the particular game play. If the generated number matches a number on which the player has placed his/her bet/wager, the animation provider module is configured to provide additional graphical animation at the specific slot. In one embodiment, the animation provider module may slow the motion of the ball at the roulette wheel as the ball approaches the specific slot corresponding to the generated number. In addition to slowing the ball, the animation provider may highlight the number associated with the specific slot in the roulette wheel. When the generated number matches a number on which the bet has been placed, the animation provider may provide animations (for e.g., stars, balloons, confetti, etc.) around the number, etc. In addition to the visual graphical animations, the animation provider may provide audio (for e.g., ringing of bells, applause, etc.), video or other forms of animation. The additional animation provided by the animation provider may include presenting an expected payout for the specific slot at the roulette wheel. The expected payout may be computed based on the amount of wager and type of wager placed by the player at the number in the grid. In one embodiment, the expected payout may be provided in the form of transparent stack of chips, wherein the number of chips in the stack corresponds to the payout.

Embodiments are presented herein with reference to an online roulette game, but the same or similar principles can be extended to other kinds of online casino games including various types of betting games (such as skill games, trivia games, shooting games, fighting games, etc.). The principles presented herein, as can be seen, may be applied to any betting game or game of chance where the outcome of the game may be rendered to inform the users where or in what the users have placed their wagers/bets and the potential payouts. It should be noted that the principles of the present embodiments may also be extended to real-world casino games. A user viewing an augmented reality (AR) version of the real-world casino games may also be presented with similar animation at a display device used for viewing the AR version of the game. In fact, the principles of the present embodiments may also be extended to any type of application that requires user notification of the outcome.

The embodiments presented may be applied to real-life money gambling so long as their implementation, all or in part, follow the pertinent rules and regulations for real-money gambling. Further, in one embodiment, the random number generator follows the prescribed rules and regulations. In addition, for real-money gambling, certain features may be adjusted or modified to follow the prescribed rules and regulations.

It is noted that the embodiments presented herein may be implemented in any computing platform having a display. For example, the game may be played on a personal computer, a tablet, a smart phone, a mobile device, a slots machine, etc. In addition, the inputs for playing the game may be entered via keyboard, buttons, mouse, touch-screen interface, gestures, voice, etc. In addition, the embodiments presented herein may also be utilized for real-life games.

Figure 2:
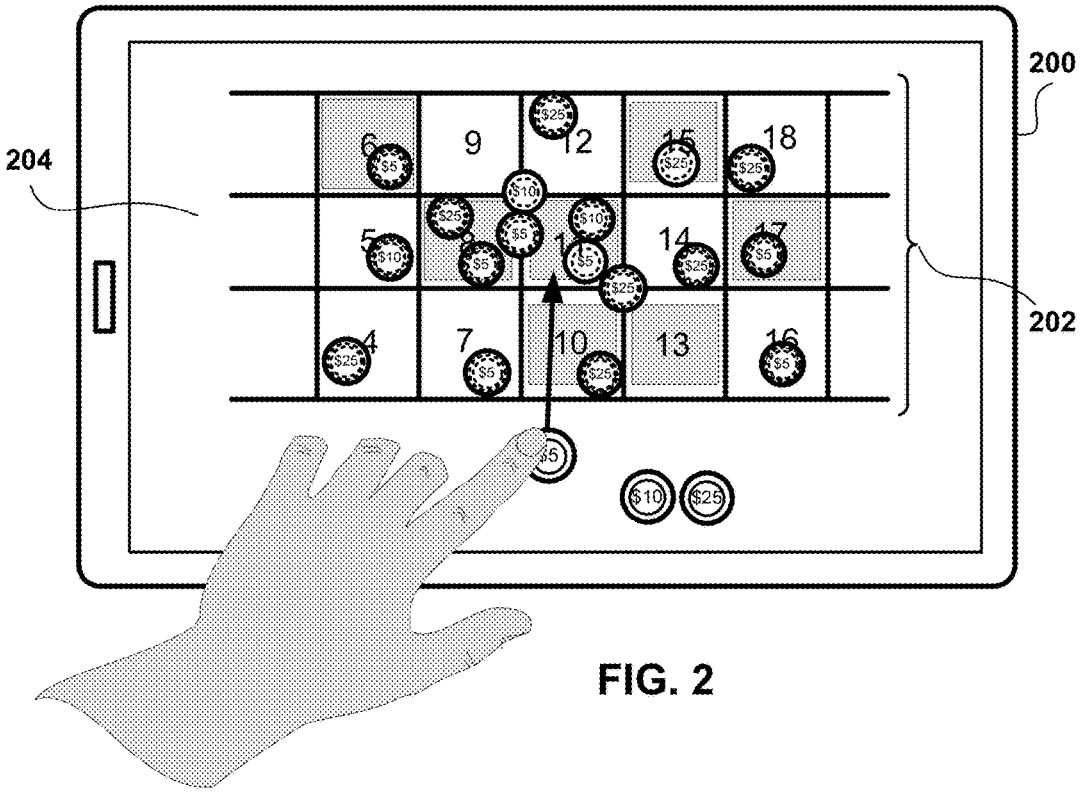
FIG. 2 illustrates a portable computing device displaying a simplified view of a roulette game, in accordance with one embodiment.

FIG. 2 illustrates a portable computing device displaying a simplified view of a roulette game, in accordance with one embodiment. As shown in FIG. 2, client device 200 displays a simplified view of roulette game 202 on screen 204. The view of the roulette game 202 is a graphical user interface (GUI) that is supported by a game mechanics model. It will be appreciated that the view of the roulette game 202 is controlled by game management software that stores the game mechanics model in volatile storage, e.g., RAM, and/or persistent storage, e.g., a database. It will further be appreciated that the view of the roulette game will be displayed by a browser running on the client device 200, e.g., a smartphone, a tablet computer, or a personal computer, based on instructions received from the game management software. In another embodiment, the roulette game could be a native application for a smartphone, e.g., an iPhone device or an Android device, or a tablet computer, e.g., an iPad tablet or an Android tablet.

The simplified view shown in FIG. 2 includes a portion of the grid of the roulette game 202 in which wagers can be placed. As shown in FIG. 2, a number of chips, which represent wagers, have been placed on the grid of the roulette game 202. In certain areas of the grid, the presence of multiple chips substantially obscures the numbers shown on the squares of the grid. For example, the number "8," which is located below number "9" in the grid, is substantially obscured by the presence of multiple chips on that square. Similarly, the number "11," which is located above number "10" in the grid, is substantially obscured by the presence of multiple chips on that square. When the numbers shown on the squares of the grid are obscured, it can be difficult for players to place their wagers at the desired locations. As indicated by the arrow shown in FIG. 2, the player is using his/her finger to drag a $5 chip toward number "11" in the grid to place a wager on that number. To make it easier for the player to place this wager, a selection window is displayed, as described in more detail below with reference to FIGS. 3-7.

Figure 3:
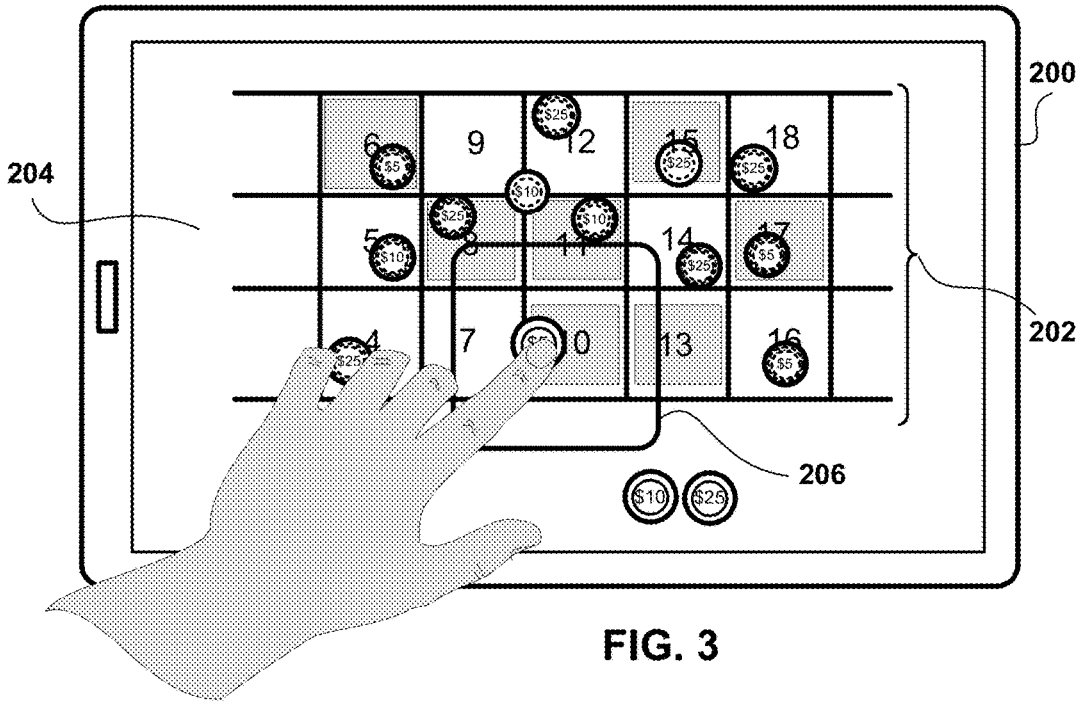
FIG. 3 illustrates the selection window that appears when a player drags a chip onto the wagering grid to place a wager, in accordance with one embodiment.

FIG. 3 illustrates the selection window that appears when a player drags a chip onto the grid to place a wager, in accordance with one embodiment. As shown in FIG. 3, selection window 206 surrounds the chip that the player is dragging over the number "10" in the grid in the course of making a wager on number "11." The selection window 206 provides an uncluttered view of the grid by removing all of the chips within the selection window except for the chip (or chips) being moved by the player (compare, e.g., the chips shown on the number "10" in FIGS. 2 and 3). In addition, as an optional feature, the selection window also can provide "zoom" functionality that magnifies the view being shown within the selection window (see FIG. 9).

Figure 4:
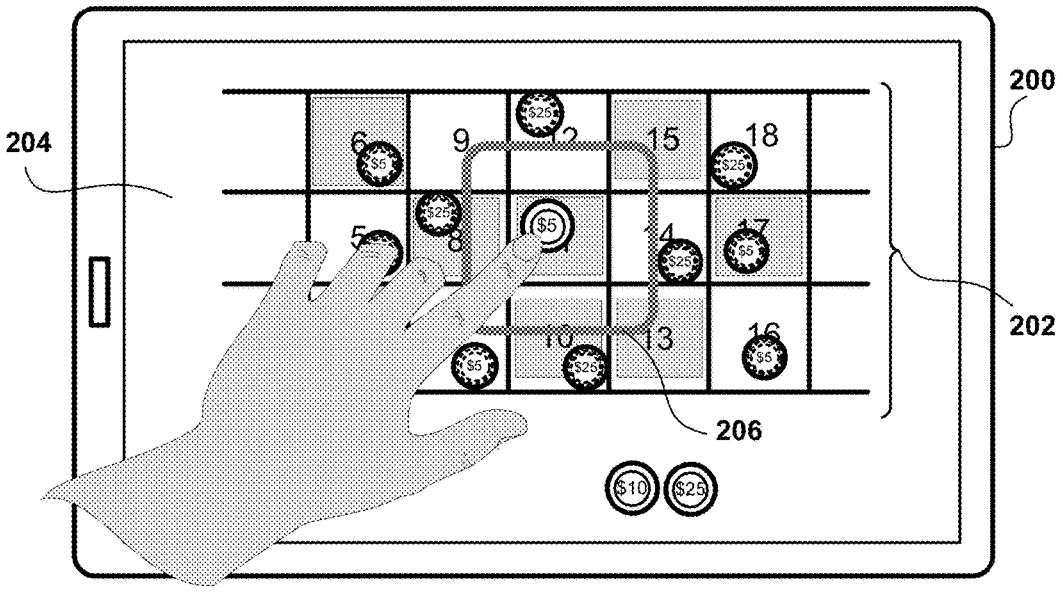
FIG. 4 illustrates the selection window displayed over the wagering grid as the player decides whether to place a wager, in accordance with one embodiment.
Figure 5:
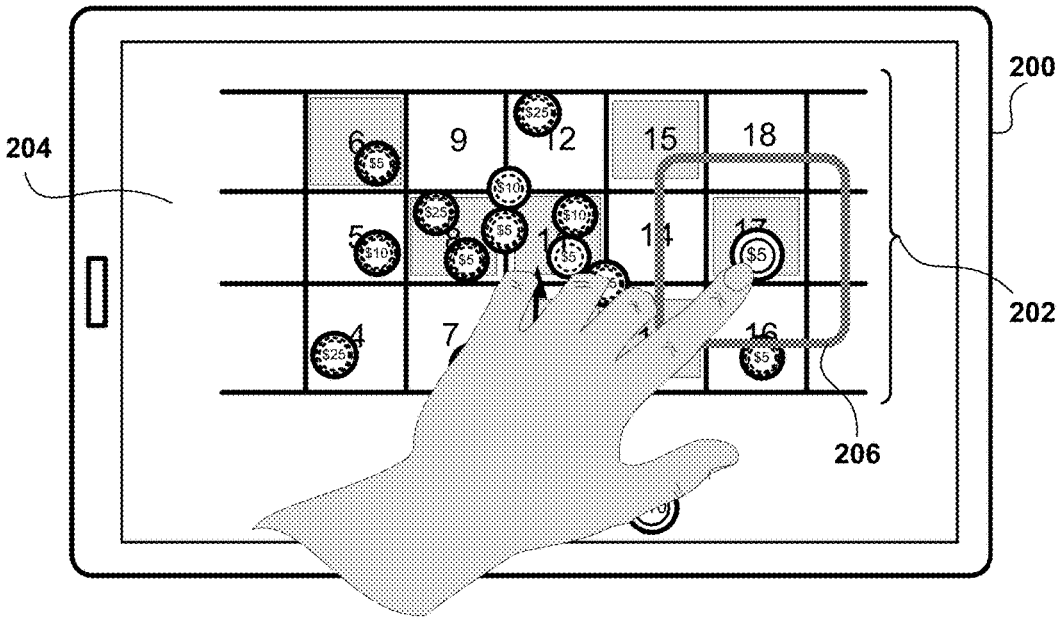
FIG. 5 illustrates the selection window displayed over the wagering grid after the selection window has been moved to a different location to place a wager, in accordance with one embodiment.

FIG. 4 shows the selection window displayed over the grid as the player decides whether to place a wager. As shown in FIG. 4, the player has dragged the $5 chip onto number "11" on the grid and can place a wager on that number by releasing the chip. The selection window 206 provides the player with an uncluttered view of number "11" on the grid as well as the surrounding area by removing all of the chips from the view, except for the $5 chip that the player has moved onto the grid (compare the cluttered view of number "11" shown in FIG. 2 with the uncluttered view shown in FIG. 4). At this point, the player decides to place a wager on number "17" instead of number "11." As such, instead of releasing the $5 chip on number "11," the player drags the chip onto number "17," as shown in FIG. 5. As the player moves the $5 chip across the grid, the selection window 206 moves with the chip so as to provide the player with an uncluttered view of the grid in the area proximate to the chip. As can be seen in FIG. 5, when the selection window is moved away from number "11," the chips placed on number "11" become visible to the player again (compare the cluttered view of number "11" shown in FIG. 5 with the uncluttered view of number "11" shown in selection window 206 of FIG. 4).

Figure 6:
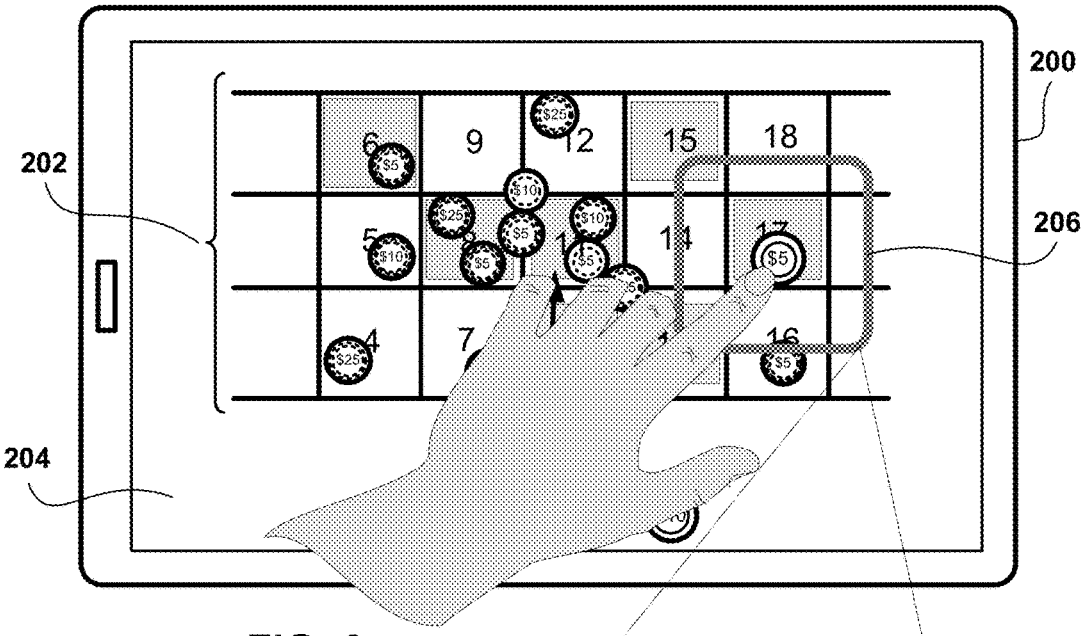
FIG. 6 illustrates one part of the process by which a player can place a wager and save that wager for use in subsequent game play, in accordance with one embodiment.
Figure 7:
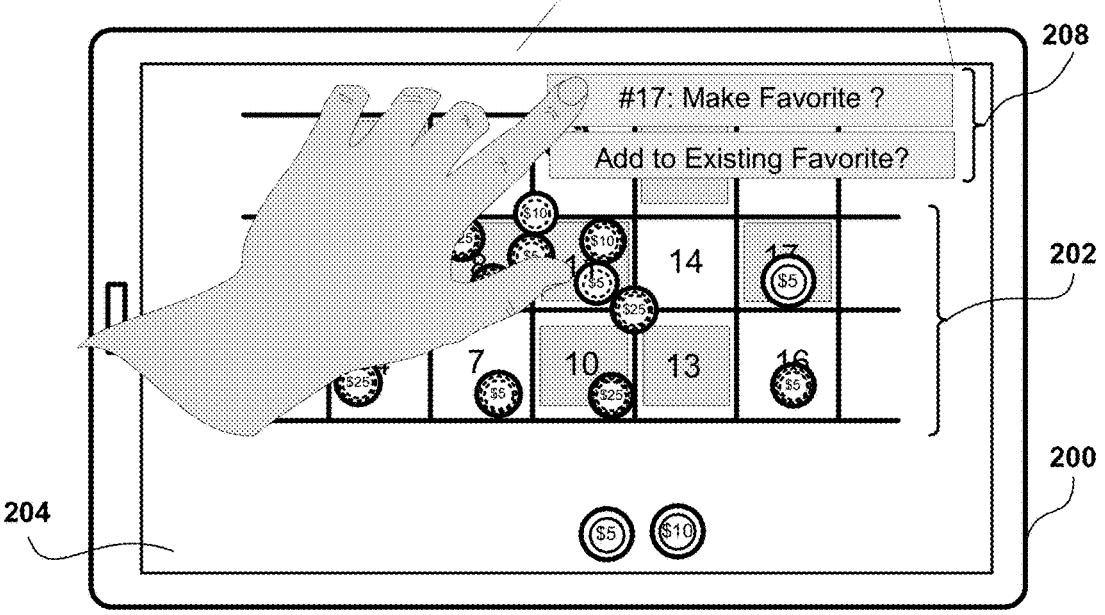
FIG. 7 illustrates another part of the process by which a player can place a wager and save that wager for use in subsequent game play, in accordance with one embodiment.

FIGS. 6 and 7 illustrate the manner in which a player can place a wager and save that wager for future use, in accordance with one embodiment. As shown in selection window 206 of FIG. 6, the player has a $5 chip positioned on the number "17" in the grid. To place a wager on number "17," the player can simply release his/her finger from the chip. To save this wager (or any other wager that has just been made), the player can make a gesture, e.g., a double tap, a long press (press and hold), etc., and a suitable view that enables the user to save the wager for future use will be displayed. As shown in FIG. 7, the view is a dialog window 208 that enables the player to 1) save the wager on number "17" as a "favorite" wager, and/or 2) add the wager on number "17" to an existing favorite wager. To accomplish options 1) and/or 2), the player can make a tap or other suitable gesture at the appropriate location (or locations) in dialog window 208. By way of example, if a player has an existing saved wager on numbers 16 and 22, selecting the "add to existing favorite?" option for the wager on number "17" would result in that wager being added to the existing saved wager. Thus, the resulting "favorite" wager saved for future use would include numbers 16, 17, and 22.

To enable players to keep track of wagers saved for future use, after the wager has been saved, a suitable view that enables a player to associate a name with a saved wager can be displayed. By way of example, dialog window 208 can be configured to allow a player to input a name to be associated with a saved wager. For instance, if a player has a saved wager that includes numbers 12, 19, and 27, which correspond to the days of the month on which his/her children were born, the player might opt to name this saved wager "Birthdays." To enable access to the saved wagers, an appropriate graphical user interface (GUI) control, e.g., a button, can be provided in the view of the roulette game. In the example shown in FIG. 8, a button, which includes a "#" icon and the text "FAV #'s", is provided in the view of the roulette game (see the controls provided at the bottom of the view of FIG. 8). When a player presses the "FAV #'s" button, a suitable view that enables the player to select a saved wager is displayed. In this manner, the "FAV #'s" button acts a shortcut when the player seeks to place one of the saved wagers.

Figure 8:
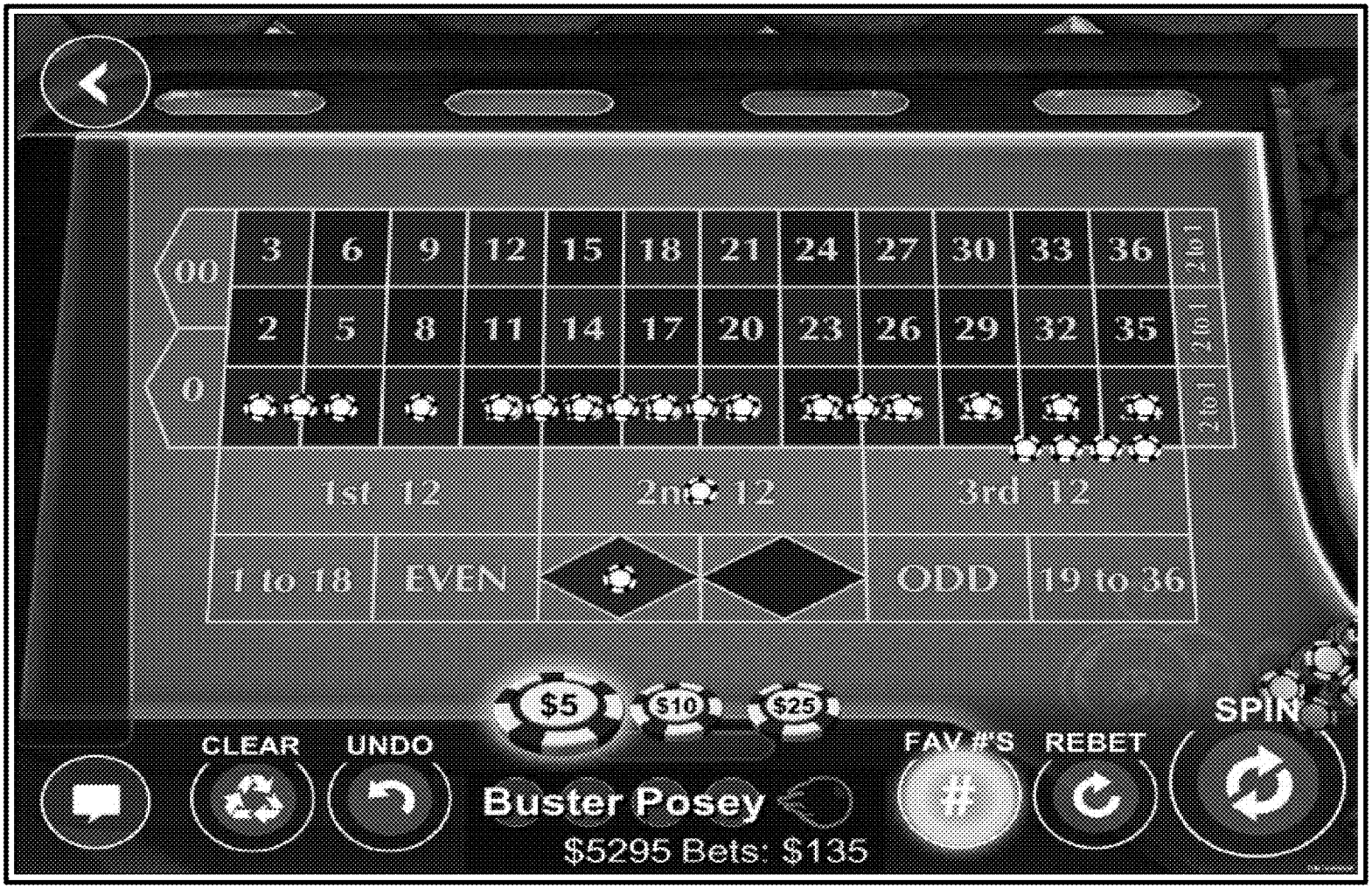
FIG. 8 illustrates a view of the roulette game that includes, among other features, a button to enable a player to access saved wagers.

As shown in FIG. 8, the GUI controls provided at the bottom of the view also include a social messaging button, a clear button, an undo button, a rebet button, and a spin button. The social messaging button, which includes a dialog bubble icon, causes a view to be displayed that enables a player to communicate with others via a social network, e.g., Twitter, Facebook, etc. The clear button, which includes a "recycle" icon and the text "CLEAR," enables a player to clear any bets that the player has made before the roulette wheel is spun. The undo button, which includes an "undo" icon and the text "UNDO," enables a player to erase the last move that the player made in the roulette game, e.g., placing a bet. The rebet button, which includes a "redo" icon and the text "REBET," enables a player to place the same wager (or wagers) that was placed for the prior spin of the roulette wheel. Thus, the rebet button acts as a shortcut when the player seeks to repeat wagers for consecutive spins of the roulette wheel. The spin button, which includes a "refresh" icon and the text "SPIN," enables a player to initiate the start of a roulette game by signaling for the roulette wheel to be spun. In one example, when one player presses the spin button, the view of the spin button will be updated to indicate that the spin button has been deactivated, e.g., by graying out the spin button. Further, a countdown will be commenced that gives the other players a period of time during which they can place wagers before the wheel is spun (and wagering is closed).

Figure 9:
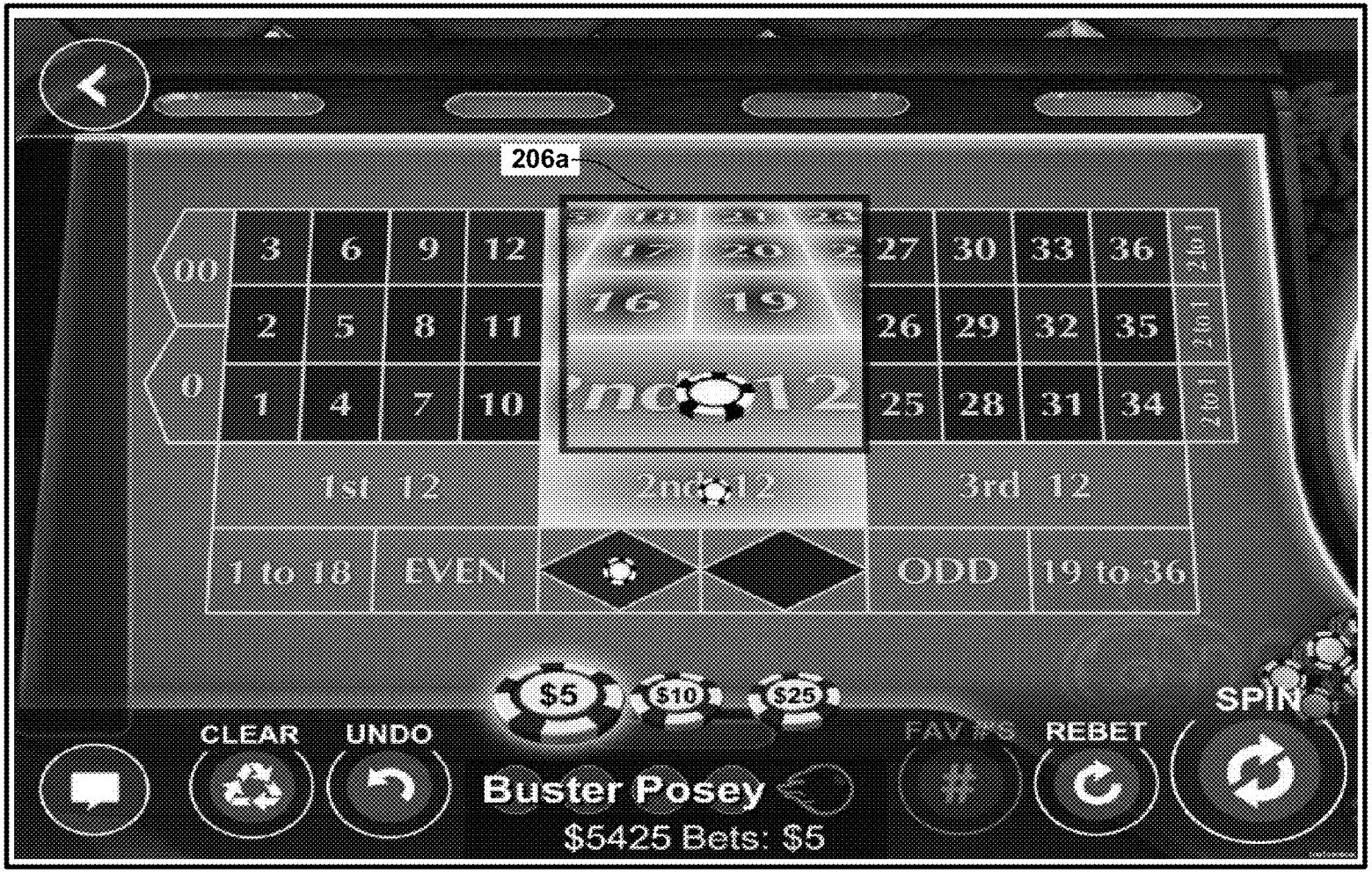
FIG. 9 illustrates a view of the roulette game that includes a selection window that provides "zoom" functionality, in accordance with one embodiment.

FIG. 9 illustrates a selection window that provides "zoom" functionality, in accordance with one embodiment. As shown in FIG. 9, selection window **906*a* surrounds the chip that the player is dragging over the "2nd 12" area of the grid in the course of making a wager on the numbers included in that wager (numbers 13-24). The selection window 906***a* provides an uncluttered view of the grid by removing all of the chips within the selection window except for the chip (or chips) being moved by the player (compare, e.g., the chips shown numbers 16 and 19 in FIG. 8 with the view shown in selection window 206*a* of FIG. 9). In addition, selection window 206*a* provides "zoom" functionality that magnifies the view being shown within the selection window (compare the size of the numbers shown within selection window 206*a* with the size of the numbers shown in the grid outside of the selection window). The degree of magnification within the selection window 906*a* (e.g., 125%, 150%, 200%, etc.) can be varied to provide a player with a view sufficient to place a desired wager, e.g., on a particular number, on the line between two numbers, at the intersection of four numbers, etc.

Figure 10:
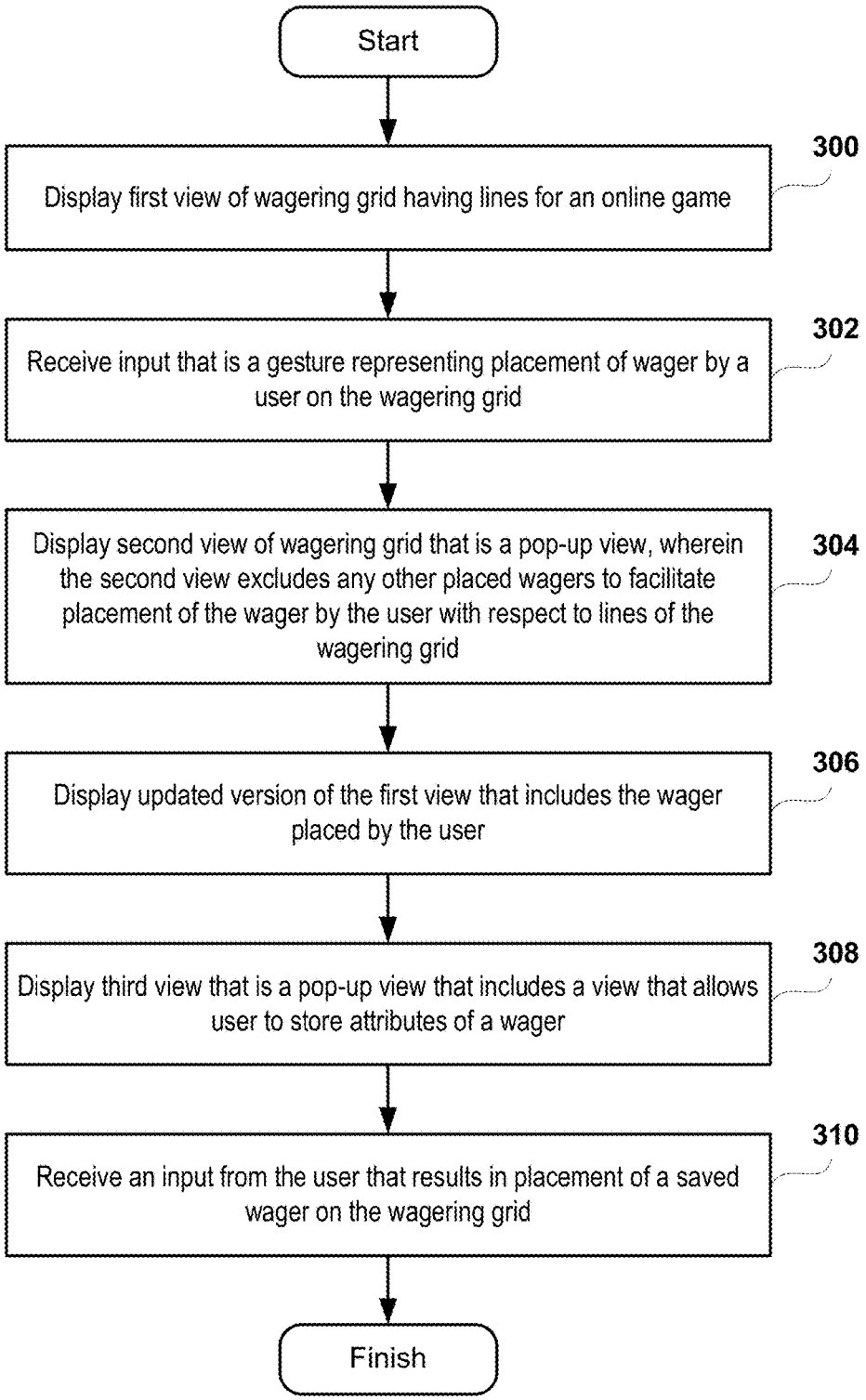
FIG. 10 is a flowchart diagram illustrating the method operations that can be performed in connection with the placement of wagers in an online game, in accordance with one embodiment.

FIG. 10 is a flowchart diagram illustrating the method operations performed in connection with the placement of wagers in an online game, in accordance with one embodiment. Operation 300 includes displaying a first view of a wagering grid for an online game, e.g., a roulette game. In one example, the wagering grid has lines as shown, for example, in FIGS. 2-9. Operation 302 includes receiving an input that is a gesture representing placement of a wager by a user on the wagering grid. The input that is a gesture can be, for example, dragging a chip across the wagering grid or releasing a chip at a desired location on the wagering grid. Operation 304 includes displaying a second view of the wagering grid, with the second view being, in one example, a pop-up view. The second view excludes any other placed wagers to facilitate placement of the wager by the user with respect to the lines of the wagering grid (see, for example, the uncluttered view shown in selection window 206 of FIG. 4). In addition, the second view can be a zoomed view or a magnified view to make it easier for the user to place a wager at the desired location on the wagering grid, as discussed above with reference to FIG. 9.

The method continues with operation 306, which includes displaying an updated version of the first view that includes the wager placed by the user. In one example, when a user releases a chip at a desired location on the wagering grid to place a wager, the second view, e.g., the pop-up view, is closed. In addition to the wager placed by the user, the updated version of the first view includes any other wagers that have been placed, e.g., other wagers placed by the user, wagers placed by other users, etc. Operation 308 includes displaying a third view that is a pop-up view that includes a menu that allows the user to save attributes of the wager for use in subsequent game play. In one example, the attributes of the wager that can be saved include the amount of the wager and the placement of the wager with respect to the lines of the wagering grid. In addition, the saved wager can be associated with a name, as described above in connection with the descriptions of FIGS. 6-8. In one example, the third view is displayed in response to an input by the user that is a gesture. The gesture, by way of example, can be a double tap, a long press (press and hold), etc. Operation 310 includes receiving an input from the user that results in placement of a saved wager on the wagering grid. In one example, the user can place a saved wager on the wagering grid by pressing the "#" button, which is located below the text "FAV #'s" (see FIG. 105). This button press causes a view that lists the saved wagers to be displayed. The user can select one (or more) of the saved wagers from the list and the selected saved wager (or wagers) will be placed on the wagering grid at the appropriate locations. The user can select one (or more) of the saved wagers from the list of saved wagers by, for example, providing an input that is a gesture, e.g., a tap, a double tap, a button press, a long press (press and hold), etc. Once the saved wager has been placed on the wagering grid, the method is finished.

Figure 11:
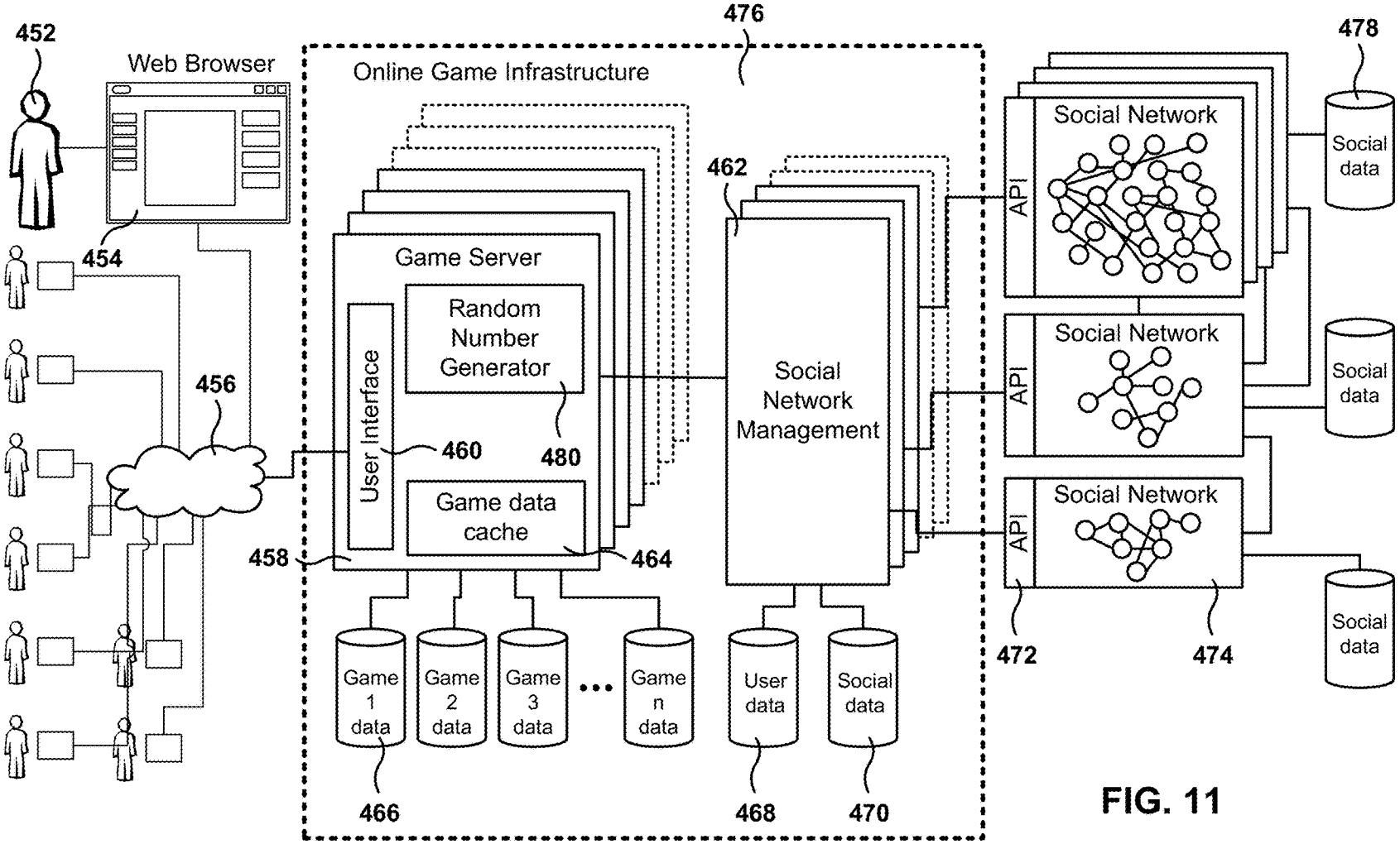
FIG. 11 illustrates an implementation of a Massively Multiplayer Online (MMO) infrastructure, according to one embodiment.

FIG. 11 illustrates an implementation of an online game infrastructure, according to one embodiment. The online game infrastructure 476 includes one or more game servers 458, web servers (not shown), one or more social network management servers 462, and databases to store game related information. In one embodiment, game server 458 provides a user interface 460 for players 452 to play the online game. In one embodiment, game server 458 includes a Web server for players 452 to access the game via web browser 454, but the Web server may also be hosted in a server different from game server 458. The web browser 454 is provided on a client device, such as a lap top computing device, a desk top computing device, a mobile computing device, a table computing device, or any combinations thereof, and is used to interact with the web server, cloud server, etc. Network 456 interconnects players 452 with the one or more game servers 458.

Each game server 458 has access to one or more game databases 466 for keeping game data and random number generator 480. In addition, a single database can store game data for one or more online games. Each game server 458 may also include one or more levels of caching. Game data cache 464 is a game data cache for the game data stored in game databases 466. For increased performance, caching may be performed in several levels of caching. For instance, data more frequently used is stored in a high priority cache, while data requiring less access during a session will be cached and updated less frequently.

The number of game servers 458 changes over time, as the gaming platform is an extensible platform that changes the number of game servers according to the load on the gaming infrastructure. As a result, the number of game servers will be higher during peak playing times, and the number of game servers will be lower during off-peak hours. In one embodiment, the increase or decrease of bandwidth is executed automatically, based on current line usage or based on historical data.

One or more social network management servers 462 provide support for the social features incorporated into the online games. The social network management servers 462 access social data 478 from one or more social networks 474 via Application Programming Interfaces (API) 472 made available by the social network providers. An example of a social network is Facebook, but it is possible to have other embodiments implemented in other social networks. Each social network 474 includes social data 478, and this social data 478, or a fraction of the social data, is made available via API 472. As in the case of the game servers, the number of social network management servers 462 that are active at a point in time changes according to the load on the infrastructure. As the demand for social data increases, the number of social network management servers 462 increases. Social network management servers 462 cache user data in database 468, and social data in database 470. The social data may include the social networks where a player is present, the social relationships for the player, the frequency of interaction of the player with the social network and with other players, etc. Additionally, the user data kept in database 468 may include the player's name, demographics, e-mail, games played, frequency of access to the game infrastructure, etc.

It is noted that the embodiment illustrated in FIG. 11 is an exemplary online gaming infrastructure. Other embodiments may utilize different types of servers, databases, APIs, etc., and the functionality of several servers can be provided by a single server, or the functionality can be spread across a plurality of distributed servers. The embodiment illustrated in FIG. 11 should therefore not be interpreted to be exclusive or limiting, but rather exemplary or illustrative.

Figure 12:
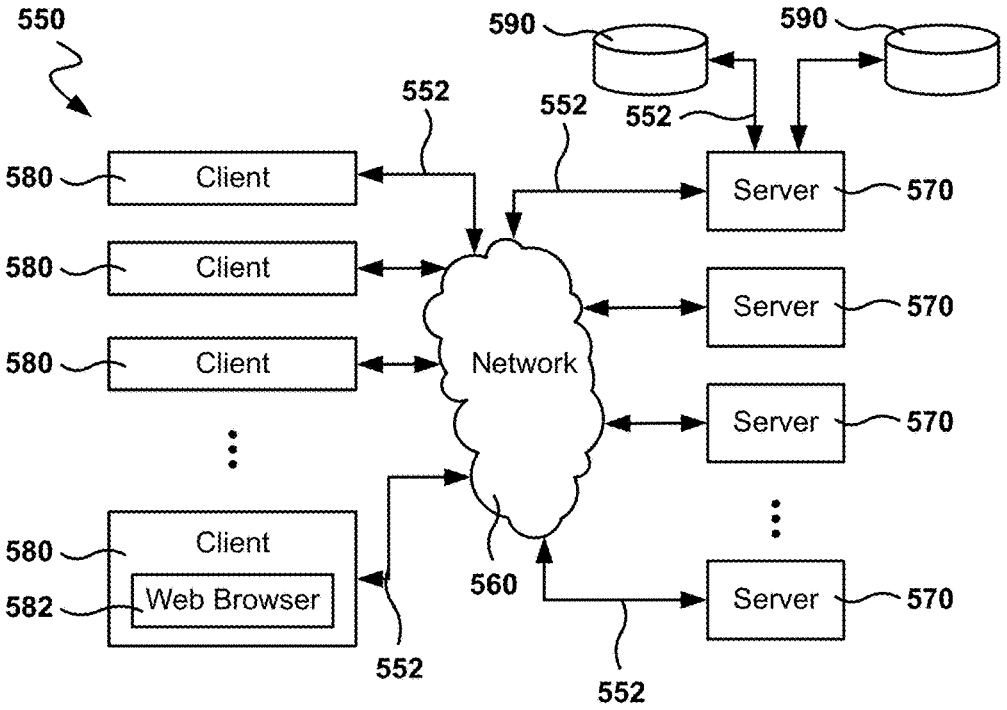
FIG. 12 illustrates an example network environment suitable for implementing embodiments.

FIG. 12 illustrates an example network environment 550 suitable for implementing embodiments. Network environment 550 includes a network 560 coupling one or more servers 570 and one or more clients 580 to each other. In particular embodiments, network 560 is an intranet, an extranet, a virtual private network (VPN), a local area network (LAN), a wireless LAN (WLAN), a wide area network (WAN), a metropolitan area network (MAN), a portion of the Internet, another network, or a combination of two or more such networks 560.

One or more links 552 couple a server 570 or a client 580 to network 560. In particular embodiments, one or more links 552 each includes one or more wired, wireless, or optical links 552. In particular embodiments, one or more links 552 each includes an intranet, an extranet, a VPN, a LAN, a WLAN, a WAN, a MAN, a portion of the Internet, or another link 552 or a combination of two or more such links 552.

Each server 570 may be a stand-alone server or may be a distributed server spanning multiple computers or multiple datacenters. Servers 570 may be of various types, such as, for example and without limitation, community server, web server, news server, mail server, message server, advertising server, file server, application server, exchange server, database server, or proxy server. Each server 570 may include hardware, software, embedded logic components, or a combination of two or more such components for carrying out the appropriate functionalities implemented or supported by server 570. For example, a web server is generally capable of hosting websites containing web pages or particular elements of web pages. More specifically, a web server may host HyperText Markup Language (HTML) files or other file types, or may dynamically create or constitute files upon a request, and communicate them to clients 580 in response to Hypertext Transfer Protocol (HTTP) or other requests from clients 580. A mail server is generally capable of providing electronic mail services to various clients 580. A database server is generally capable of providing an interface for managing data stored in one or more data stores.

In particular embodiments, one or more data storages 590 may be communicatively linked to one or more severs 570 via one or more links 552. Data storages 590 may be used to store various types of information. The information stored in data storages 590 may be organized according to specific data structures. In particular embodiments, each data storage 590 may be a relational database. Particular embodiments may provide interfaces that enable servers 570 or clients 580 to manage, e.g., retrieve, modify, add, or delete, the information stored in data storage 590.

In particular embodiments, each client 580 may be an electronic device including hardware, software, or embedded logic components or a combination of two or more such components and capable of carrying out the appropriate functionalities implemented or supported by client 580. For example and without limitation, a client 580 may be a desktop computer system, a notebook computer system, a notebook computer system, a handheld electronic device, or a mobile telephone. A client 580 may enable a network player at client 580 to access network 580. A client 580 may enable its player to communicate with other players at other clients 580. Further, each client 580 may be a computing device, such as a desktop computer or a work station, or a mobile device, such as a notebook computer, a network computer, or a smart telephone.

In particular embodiments, a client 580 may have a web browser 582, such as Microsoft Internet Explorer, Google Chrome, Or Mozilla Firefox, and may have one or more add-ons, plug-ins, or other extensions. A player at client 580 may enter a Uniform Resource Locator (URL) or other address directing the web browser 582 to a server 570, and the web browser 582 may generate a Hyper Text Transfer Protocol (HTTP) request and communicate the HTTP request to server 570. Server 570 may accept the HTTP request and communicate to client 580 one or more Hyper Text Markup Language (HTML) files responsive to the HTTP request. Client 580 may render a web page based on the HTML files from server 570 for presentation to the user. The present disclosure contemplates any suitable web page files. As an example and not by way of limitation, web pages may render from HTML files, Extensible Hyper Text Markup Language (XHTML) files, or Extensible Markup Language (XML) files, according to particular needs. Such pages may also execute scripts such as, for example and without limitation, those written in Javascript, Java, Microsoft Silverlight, combinations of markup language and scripts such as AJAX (Asynchronous Javascript and XML), and the like. Herein, reference to a web page encompasses one or more corresponding web page files (which a browser may use to render the web page) and vice versa, where appropriate.

Web browser 582 may be adapted for the type of client 580 where the web browser executes. For example, a web browser residing on a desktop computer may differ (e.g., in functionalities) from a web browser residing on a mobile device. A user of a social networking system may access the website via web browser 582.

Figure 13:
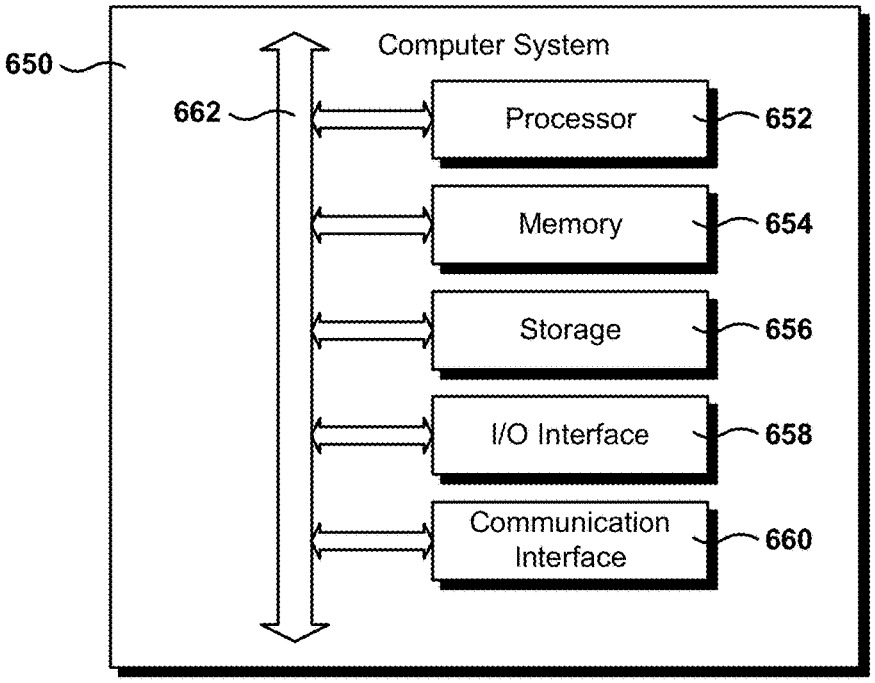
FIG. 13 illustrates an example computer system for implementing embodiments.

FIG. 13 illustrates an example computer system 650 for implementing embodiments. In particular embodiments, software running on one or more computer systems 650 performs one or more operations of one or more methods described or illustrated herein or provides functionality described or illustrated herein. Although methods for implementing embodiments were described with a particular sequence of operations, it is noted that the method operations may be performed in different order, or the timing for the execution of operations may be adjusted, or the operations may be performed in a distributed system by several entities, as long as the processing of the operations are performed in the desired way.

As example and not by way of limitation, computer system 650 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or a combination of two or more of these. Where appropriate, computer system 650 may include one or more computer systems 650; be stand-alone or distributed; span multiple locations; span multiple machines; or reside in a cloud, which may include one or more cloud components in one or more networks. The one or more computer systems 650 may perform in real time or in batch mode one or more operations of one or more methods described or illustrated herein.

In particular embodiments, computer system 650 includes a processor 652, memory 654, storage 656, an input/output (I/O) interface 658, a communication interface 660, and a bus 662. Although this disclosure describes and illustrates a particular computer system having a particular number of particular components in a particular arrangement, embodiments may be implemented with any suitable computer system having any suitable number of any suitable components in any suitable arrangement.

In particular embodiments, processor 652 includes hardware for executing instructions, such as those making up a computer program. As an example and not by way of limitation, to execute instructions, processor 652 may retrieve (or fetch) the instructions from an internal register, an internal cache, memory 654, or storage 656; decode and execute them; and then write one or more results to an internal register, an internal cache, memory 654, or storage 656. The present disclosure contemplates processor 652 including any suitable number of any suitable internal registers, where appropriate. Where appropriate, processor 652 may include one or more arithmetic logic units (ALUs); be a multi-core processor; or include one or more processors 652. Although this disclosure describes and illustrates a particular processor, this disclosure contemplates any suitable processor.

In particular embodiments, memory 654 includes main memory for storing instructions for processor 652 to execute, or data that can be manipulated by processor 652. As an example and not by way of limitation, computer system 650 may load instructions from storage 656 or another source (such as, for example, another computer system 650) to memory 654. Processor 652 may then load the instructions from memory 654 to an internal register or internal cache. During or after execution of the instructions, processor 652 may write one or more results (which may be intermediate or final results) to the internal register or internal cache. Processor 652 may then write one or more of those results to memory 654. One or more memory buses (which may each include an address bus and a data bus) may couple processor 652 to memory 654. Bus 662 may include one or more memory buses, as described below. One or more memory management units (MMUs) reside between processor 652 and memory 654 and facilitate accesses to memory 654 requested by processor 652. Memory 654 includes random access memory (RAM).

As an example and not by way of limitation, storage 656 may include a Hard Disk Drive (HDD), a floppy disk drive, flash memory, an optical disc, a magneto-optical disc, magnetic tape, or a Universal Serial Bus (USB) drive or a combination of two or more of these. Storage 656 may include removable or non-removable (or fixed) media, where appropriate. In particular embodiments, storage 656 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these.

In particular embodiments, I/O interface 658 includes hardware, software, or both providing one or more interfaces for communication between computer system 650 and one or more I/O devices. One or more of these I/O devices may enable communication between a person and computer system 650. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these.

Communication interface 660 includes hardware, software, or both providing one or more interfaces for communication between computer system 650 and one or more other computer systems 650 on one or more networks. As an example and not by way of limitation, communication interface 660 may include a network interface controller (NIC) or network adapter for communicating with an Ethernet or other wire-based network or a wireless NIC (WNIC) or wireless adapter for communicating with a wireless network, such as a WI-FI network. As an example, computer system 650 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these.

In particular embodiments, bus 662 includes hardware, software, or both coupling components of computer system 650 to each other. As an example and not by way of limitation, bus 662 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or another suitable bus or a combination of two or more of these. Bus 662 may include one or more buses 662, where appropriate. Although this disclosure describes and illustrates a particular bus, this disclosure contemplates any suitable bus or interconnect.

Herein, reference to a computer-readable storage medium encompasses one or more non-transitory, tangible computer-readable storage media possessing structure that may store a computer program or data. As an example and not by way of limitation, a computer-readable storage medium may include a semiconductor-based or other integrated circuit (IC) (such, as for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a Secure Digital card, a Secure Digital drive, or another suitable computer-readable storage medium or a combination of two or more of these, where appropriate. Herein, reference to a computer-readable storage medium excludes any medium that is not eligible for patent protection under 35 U.S.C. §101.

One or more embodiments can also be fabricated as computer readable code on a non-transitory computer readable medium. Herein, reference to software may encompass one or more applications, bytecode, one or more computer programs, one or more executables, one or more program instructions, logic, machine code, one or more scripts, or source code, and vice versa, where appropriate.

The present disclosure encompasses all changes, substitutions, variations, alterations, and modifications to the example embodiments herein that a person having ordinary skill in the art would comprehend.

What is claimed is:

1. A method, comprising:

displaying a first view of a wagering grid for an online game on a screen of a mobile touch-screen device, the wagering grid having lines, and the first view including a social messaging button that enables a user to communicate with others via a third party social network;

receiving an input on the screen of the mobile touch-screen device that is a dragging gesture representing placement of a wager by the user on the wagering grid;

displaying, in response to the input on the screen of the mobile touch-screen device, a second view of the wagering grid that is a magnified view of the wagering grid from the first view, the second view tracking the dragging gesture, and the second view including the lines of the wagering grid, wherein the second view excludes any other placed wagers to facilitate placement of the wager by the user with respect to the lines of the wagering grid;

closing the second view once input is no longer being received at the screen of the mobile touch-screen device and then displaying an updated version of the first view that includes the wager placed by the user; and receiving an input on the screen of the mobile touch-screen device from the user through the social messaging button and transmitting a resulting communication to the third party social network through an application programming interface, wherein the operations are performed by a processor, and wherein said displaying the first view is maintained for at least a portion of the screen of the mobile touch screen device during said displaying the second view.

2. The method of claim 1, further comprising:

displaying a third view that is a pop-up view that includes a menu that allows the user to save attributes of the wager for use in subsequent game play.

3. The method of claim 2, wherein the attributes of the wager that are saved for use in subsequent game play include an amount of the wager.

4. The method of claim 2, wherein the attributes of the wager that are saved for use in subsequent game play include placement of the wager with respect to lines of the wagering grid.

5. The method of claim 2, wherein the third view is displayed in response to an input by the user that is a gesture.

6. The method of claim 5, wherein the gesture is a long press.

7. The method of claim 2, further comprising:

receiving an input from the user that results in placement of a saved wager on the wagering grid.

8. The method of claim 7, wherein the input is a press of a button.

9. The method of claim 1, wherein the second view of the wagering grid that is a pop-up view is a selection window, and the displaying of the second view of the wagering grid includes moving the selection window with a chip as the chip is being dragged across the wagering grid, wherein the chip represents the wager placed by the user.

10. A method, comprising:

displaying a first view of a wagering grid for an online roulette game on a screen of a mobile touch-screen device, the wagering grid having lines, and the first view including a social messaging button that enables a user to communicate with others via a third party social network;

receiving an input that is a dragging gesture on the screen of a mobile touch-screen device, the dragging gesture representing placement of a wager by the user on the wagering grid;

displaying, in response to the dragging gesture, a second view of the wagering grid that is a magnified view of the wagering grid from the first view, the second view tracking the dragging gesture, and the second view including the lines of the wagering grid from the first view, wherein the second view excludes any other placed wagers to facilitate placement of the wager by the user with respect to the lines of the wagering grid;

closing the second view once input is no longer being received at the screen of the mobile touch screen device and then displaying an updated version of the first view that includes the wager placed by the user; and receiving an input at the screen of the mobile touch-screen device from the user through the social messaging button and transmitting a resulting communication to the third party social network through an application programming interface, wherein the operations are performed by a processor, and wherein said displaying the first view is maintained for at least a portion of the screen of the mobile touch-screen device during said displaying the second view.

11. The method of claim 10, further comprising:

displaying a third view that is a pop-up view that includes a menu that allows the user to save attributes of the wager for use in subsequent game play.

12. The method of claim 11, wherein the attributes of the wager that are saved for use in subsequent game play include an amount of the wager.

13. The method of claim 11, wherein the attributes of the wager that are saved for use in subsequent game play include placement of the wager with respect to lines of the wagering grid.

14. The method of claim 11, wherein the third view is displayed in response to an input by the user that is a gesture.

15. The method of claim 14, wherein the gesture is a long press.

16. The method of claim 11, further comprising:

receiving an input from the user that results in placement of a saved wager on the wagering grid.

17. The method of claim 16, wherein the input is a press of a button.

18. The method of claim 10, wherein the second view of the wagering grid that is a pop-up view is a selection window, and the displaying of the second view of the wagering grid includes moving the selection window with a chip as the chip is being dragged across the wagering grid, wherein the chip represents the wager placed by the user.

19. A non-transitory computer-readable medium having a computer program stored therein, the computer program, when executed by a processor, causing a computer to perform the following operations:

display a first view of a wagering grid for an online game on a screen of a mobile touch-screen device, the wagering grid having lines, and the first view including a social messaging button that enables a user to communicate with others via a third party social network;

receive, at the screen of the mobile touch-screen device, an input that is a dragging gesture, the dragging gesture representing placement of a wager by the user on the wagering grid;

display, in response to the input, a second view of the wagering grid that is a magnified view of the wagering grid from the first view, the second view including the lines of the wagering grid from the first view, and the second view tracking the dragging gesture, wherein the second view excludes any other placed wagers to facilitate placement of the wager by the user with respect to the lines of the wagering grid;

close the second view once input is no longer being received at the screen of the mobile touch-screen device and then display an updated version of the first view that includes the wager placed by the user; and receive an input at the screen of the mobile touch-screen device from the user through the social messaging button and transmit a resulting communication to the third party social network through an application programming interface;

wherein said displaying the first view is maintained for at least a portion of the screen of the mobile touch-screen device during said displaying the second view.

20. The computer-readable medium of claim 19, wherein the online game is a roulette game.

* * * * *